US005570060A

United States Patent [19]

Edwards

[11] Patent Number: 5,570,060

[45] Date of Patent: Oct. 29, 1996

[54] CIRCUIT FOR LIMITING THE CURRENT IN A POWER TRANSISTOR

[75] Inventor: William E. Edwards, Milford, Mich.

[73] Assignee: SGS-Thomson Microelectronics, Inc., Carrollton, Tex.

[21] Appl. No.: 411,498

[22] Filed: Mar. 28, 1995

[51] Int. Cl.[6] ..... G05F 3/02

[52] U.S. Cl. ..... 327/541; 327/538; 327/540; 327/546; 323/313; 323/315

[58] Field of Search ..... 323/312, 313, 323/315; 327/309, 331, 538, 540, 541, 543, 545, 546

[56] References Cited

U.S. PATENT DOCUMENTS

| | | | |
|---|---|---|---|
| 3,718,864 | 2/1973 | Kelly et al. | 327/78 |
| 4,327,320 | 4/1982 | Oguey et al. | 323/313 |
| 4,338,646 | 7/1982 | Davis et al. | 323/315 |
| 4,438,349 | 3/1984 | Shoji | 327/78 |
| 4,477,737 | 10/1984 | Ulmer et al. | 327/562 |
| 5,061,862 | 10/1991 | Tamagawa | 327/541 |
| 5,077,518 | 12/1991 | Han | 323/313 |
| 5,159,260 | 10/1992 | Yoh et al. | 323/313 |
| 5,268,595 | 12/1993 | Ohshima | 327/77 |

OTHER PUBLICATIONS

IEEE Journal of Solid–State Circuits, Degrauwe et al., Jun. 1982, pp. 522–528.

*Primary Examiner*—Terry Cunningham

*Attorney, Agent, or Firm*—Joseph C. Arrambide; Lisa K. Jorgenson

[57] ABSTRACT

A current limiting circuit used with voltage regulators or other similar circuits is disclosed. The current limiting circuit uses two transistors, configured as a differential pair, combined with a fixed current source to limit the current available to a pass transistor of the voltage regulator.

5 Claims, 1 Drawing Sheet

CIRCUIT FOR LIMITING THE CURRENT IN A POWER TRANSISTOR

BACKGROUND OF THE INVENTION

1. Field of the Invention

This invention relates to electronic circuits used to current-limit the outputs of power supplies and more specifically to circuits used to limit the output current of voltage regulators or other similar circuits.

2. Description of the Relevant Art

Voltage regulators are designed to provide a constant voltage over a variety of load impedances. As the impedance of the load increases, the voltage regulator requires less output current to keep the load at a constant voltage. Conversely, as the impedance of the load decreases, more current is required to maintain the same constant voltage. The problem addressed by this invention is encountered in voltage regulator circuits when the output current required to maintain a constant voltage is greater than the safe operating condition of the pass (output) transistors of the voltage regulator. Therefore, it is common for voltage regulator circuits to have over-current protection to limit the output current to a safe operating condition.

FIG. 1, shows the output of a voltage regulator with a over-current protection as is known in the prior art. The circuit operates by error amplifier 10 receiving a reference voltage, $V_{trk}$. The reference voltage $V_{trk}$ is the desired output voltage of the voltage regulator circuit 8. Error amplifier 10 drives the base of the pass transistor 14 proportional to the amount of current necessary to maintain the output, $V_{out}$, of the voltage regulator at the $V_{trk}$ voltage. If $V_{out}$ begins to fall below $V_{trk}$, the output of the error amplifier 10 rises which increases the base voltage of pass transistor 14 thereby driving more current into the $V_{out}$ node which raises the $V_{out}$ voltage.

The over-current protection circuit consists of current source 12 and transistor 16, and sense resistor 18. Sense resistor 18 is typically a very low resistance resistor which can handle the large currents of the pass transistor 14. As the current through transistor 14 and resistor 18 increases, the voltage drop across sense resistor 18 increase. Therefore, the resistance of sense resistor can be selected so that transistor 16 turns on when the current through sense resistor 18 reaches an unsafe operating current for any component of the voltage regulator circuit 8. As the load current increases, the voltage drop across resister 18 causes transistor 16 to begin to conduct. The collector current of transistor 16 shunts away available base current for transistor 14 supplied by current source 12 thereby limiting the output current (the output current is the base current×the beta of the transistor, as is known in the art). As output load increases, the base current for transistor 14 decreases. The characteristics of current source 12, pass transistor 14, and transistor 16 can be selected to limit the maximum current transistor 14 can deliver to a load. Thus, transistor 16 and resistor 18 limit the output current in transistor 14 during an over-current condition by controlling the base current to transistor 14.

As an example to illustrate the operation of the prior art circuit in FIG. 1, the safe operating current of pass transistor 14 may be limited to 1 amp and transistor 16 may be forward biased at around 0.7 volts. Then, a sense resistor of around:

0.7 volts/1.amp=0.7 ohms would be required for the over-current protection circuit to limit the current to 1 amp. At about one amp, the voltage across sense resistor 18 is around 0.7 volts. Thus, transistor 16 begins to shunt the current from the base of pass transistor 14 which consequently limits the current through the pass transistor 14 to the save operating current.

In the prior art circuit of FIG. 1, the sense resistor 18 is required to detect the over-current condition. As current flows through the sense resistor 18, the resulting voltage drop can be problematic since power is dissipated in the chip, since load regulation is deteriorated, and drop-out voltage is increased. Additionally, a sense resistor is undesirable since it requires a significant amount of area on an integrated circuit.

FIG. 2, shows a second voltage regulator with an over-current protection as is also known in the prior art. Like FIG. 1, voltage regulator 40 has an error amplifier 10 for receiving a $V_{trk}$ voltage and a pass transistor 14. However, voltage regulator 40 does not have a sense resistor 18.

Voltage regulator 40 operates by error amplifier 10 driving pass transistor 14 in response to the difference in voltage between $V_{trk}$ and $V_{out}$. The lower the voltage $V_{out}$ is relative to $V_{trk}$, the higher the voltage on the gate, relative to the source, of pass transistor 14 and thus the more current driven through pass transistor 14.

In voltage regulator 40, the over-current protection circuit includes transistors 22, 24, 26, 28, 34, and 36, current source 30, and capacitor 32. The gate of transistor 24 is connected to the output of error amplifier 10 and to the gate of pass transistor 14. Consequently, a current flows through transistor 24 which is proportional to the current through transistor 14. The proportion is determined by the ratio of the relative sizes of the two transistors, as is well known in the art. The current through transistor 24 is mirrored by transistor 36 to 34. Current source 30 provides a reference current which is mirrored by transistors 26 and 28 and, thus, transistor 28 acts as an active load to transistor 34. Capacitor 32 acts as the compensation capacitor and may be necessary to avoid oscillations on this node. Transistor 22 is controlled by the voltage drop across transistor 28 which is controlled by the current through transistor 34 since the gate of transistor 22 is connected to drain of transistors 28 and 34.

In operation, error amplifier 10 regulates the output voltage $V_{out}$ by controlling the current through transistor 14 by controlling the voltage on the gate of transistor 14. The current through transistor 14 is scaled down and transmitted through transistor 24 since the gate of transistor 24 an 14 are connected together. The current through transistor 24 is mirrored by transistor 36 and 34. At the same time, current source 30 provides a reference current which is mirrored by transistors 26 and 28. Therefore, transistor 28 acts like a load resistor to the drain of transistor 34. When the output current is low, the current in transistors 24, 36, and 34 is relatively low and thus the voltage drop across transistor 28 is not large enough to turn on transistor 22. Hence, transistor 14 is controlled by error amplifier 10. Conversely, when the output current is high, the currents in transistors 24, 34, and 36 is high which creates a large voltage drop across transistor 28. Thus, transistor 22 is driving the gate of transistor 14 to a high voltage thereby limiting the current flow through transistor 22.

It has been observed that this circuit requires additional circuitry over circuit 8 and requires capacitor 32 to ensure stability (no oscillations) during current limiting.

SUMMARY OF THE INVENTION

Therefore, it is an object of the invention to provide a voltage regulator with a current limiting circuit which does not require a sense resistor.

It is further an object of this invention to provide a voltage regulator which does not require additional circuitry.

It is further an object of the invention to provide a voltage regulator with a current limiting circuit which is stable without a compensation capacitor.

It is further an object of the invention to provide a voltage regulator with a current fold-back feature without using additional components.

These and other objects, features, and advantages of the invention will be apparent to those skilled in the art from the following detailed description of the invention, when read with the drawings and appended claims.

The invention can be summarized as a current limiting circuit which is used to current-limit the output of a voltage regulator or other similar circuits. The current limiting circuit uses two transistors (configured as a differential pair) combined with a fixed current source. One transistors of the differential pair is connected in series to the input of a current mirror. The output of the mirror is connected to the pass transistor of the voltage regulator. The current limiting circuit limits the current available to a pass transistor of the voltage regulator.

DETAILED DESCRIPTION OF THE INVENTION

Figure 1:
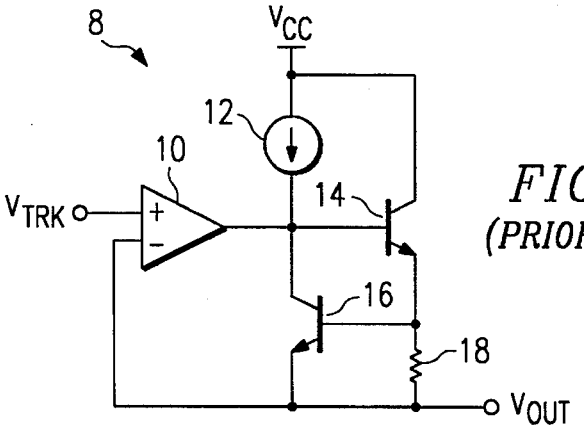
FIG. 1 (PRIOR ART)
FIG. 1 is a current limiting circuit which uses a sense resistor in a voltage regulator circuit, as known in the prior art.
Figure 2:
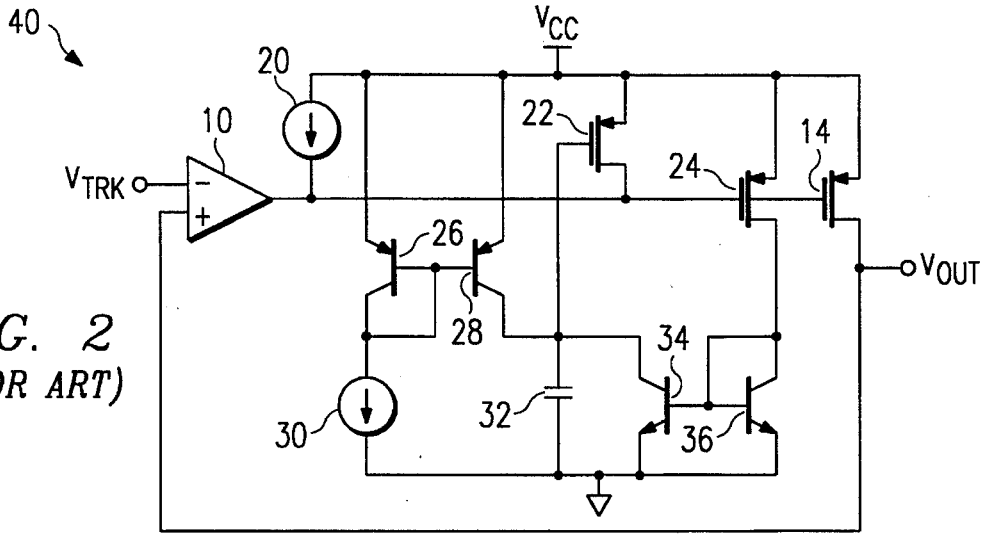
FIG. 2 (PRIOR ART)
FIG. 2 is a current limiting circuit in a voltage regulator as known in the prior art.
Figure 3:
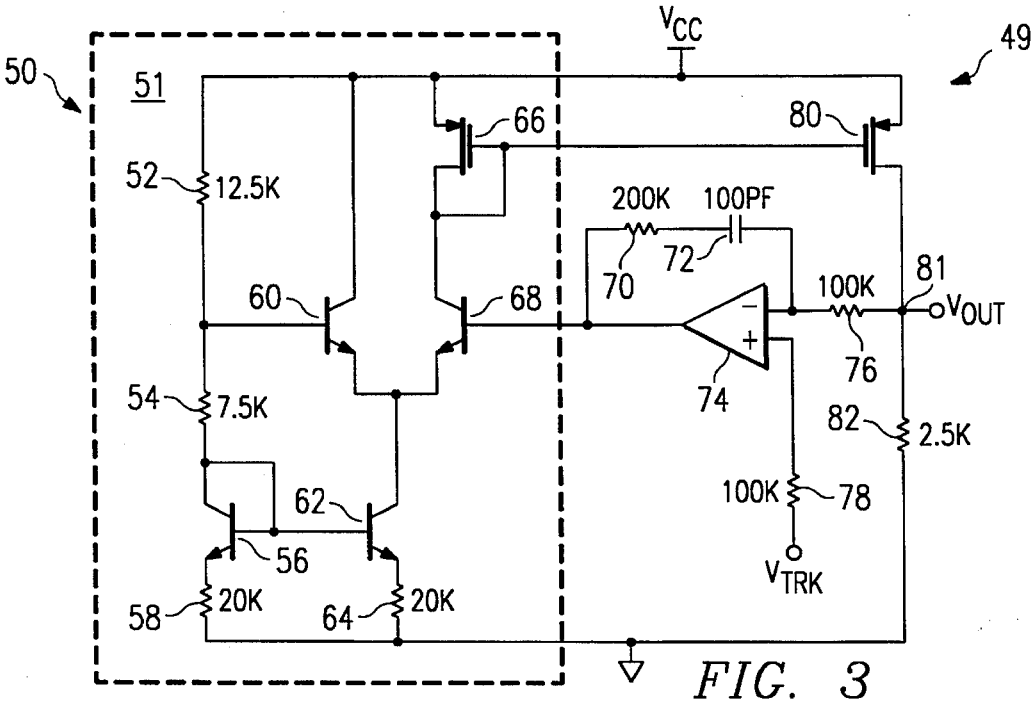
FIG. 3 is the embodiment current limiting circuit in a voltage regulator.

The construction of the invention in a voltage regulator circuit will be described. Referring now to FIG. 3, the current limit circuit 50 has a 12.5 K resistor 52 which has a first end connected to Vcc and a second end connected to the base of bipolar transistor 60 and to the first end of 7.5 K resistor 54. The second end of resistor 54 is connected to the collector and base of NPN bipolar transistor 56 and the base of NPN bipolar transistor 62. The emitter of transistor 56 is connected to the first end of 20 K resistor 58. The second end of resistor 58 is connected to a voltage reference, ground. The collector of transistor 60 is connected to Vcc. The emitter of transistor 60 is connected to an emitter of NPN bipolar transistor 68 and to the collector of transistor 62. The emitter of transistor 62 is connected to the first end of 20 K resistor 64. The second end of resistor 64 is connected to ground. The collector of transistor 68 is connected to the drain and gate of P-channel transistor 66 and to the gate of P-channel transistor 80. The sources of transistors 66 and 80 are connected to Vcc.

The pass transistor 80 of the voltage regulator is connected by connecting the drain of transistor 80 to the first end of 2.5 K resistor 82 and to the second end of 100 K resistor 76. The second end of resistor 82 is connected to ground.

The error amplifier of the voltage regulator is constructed by connecting the first end of resistor 76 to the inverting input of amplifier 74 and to the second end of 100 picofarad capacitor 72. The output of amplifier 74 is connected to the base of transistor 68 and to the first end of 200 K resistor 70. The second end of resistor 70 is connected to the first end of capacitor 72. The non-inverting input of amplifier 74 is connected to the first end of 100 K resistor 78. The second end of resistor 78 receives the $V_{trk}$ voltage. $V_{trk}$ is the input voltage which the voltage regulator will track.

The output of the voltage regulator, node 81, is formed by the connection of the second end of resistor 76 to the first end of resistor 82 and to the drain of transistor 80. Node 81 forms the output, $V_{out}$, of the voltage regulator.

In operation, the error amplifier operates by receiving a $V_{trk}$ voltage at the second end of resistor 78. Error amplifier 74 is configured as an integrator by using resistor 76 and capacitor 72, as is known in the art. The negative feedback for the error amplifier is received through resistor 76. Thus, the output of error amplifier 74 is determined by the relative voltages of $V_{trk}$ to $V_{out}$. As $V_{out}$ drops relative to $V_{trk}$, the output of amplifier 74 increases. Conversely, as $V_{out}$ rises above $V_{trk}$, the output of amplifier 74 decreases.

Current limit circuit 50 operates by using transistors 60 and 68 as a differential pair. The base of transistor 60 is biased to a voltage defined by voltage divider created by resistor 52, resistor 54, transistor 56 and resistor 58. For a Vcc value of around 12 volts and the resistor values given, the voltage at the base of transistor 60 is approximately 8.5 volts. Additionally, resistors 52, 54, and 58 and transistor 56 set a bias voltage for transistor 62. Thus, transistor 62 operates as a fixed current source for the differential pair. Therefore, the fixed current flowing through transistor 62 will either be supplied by transistor 60 or transistor 68 or a combination of the two. Since the base of transistor 60 is held at a constant voltage, the output of amplifier 74 controls the current flowing through transistor 68 which in turn controls the current flow through transistor 66 and transistor 80. Consequently, the current through transistor 80 is limited to the constant current source current times the current mirror ratio created by transistors 66 and 80. In equation form, the maximum current through pass transistor 80 can be expressed by $$I_{80,max} = I_{Ref} \times M \times N$$

$N$ = the ratio of gate widths between transistors 80 and 66
= Width transistor 80/width of transistor 60

$M$ = the ratio of emitter areas between transistors 56 and 62
= A62/A56

$$I_{Ref} = (Vcc - V_{be,56})/(R_{52} + R_{54} + R_{58})$$

This invention is advantageous over the prior art since it does not require a sense resistor which would require significant area on the integrated circuit or a compensation.

Additionally, this embodiment provides a current fold-back feature without any additional components. Current fold-back is the reduction of output current below $I_{out}$, limit after the regulator has gone into the current limit mode. In this circuit, the current fold-back occurs since the output current is limited to $I_{80,max}=I_{Ref}\times M\times N$ as described above. As the load increases beyond this point, amp 74 increases its output to try to drive more current to the output. Instead, transistor 68 is driven into saturation and the voltage on the base of transistor 68 is passed onto the gates of transistors 66 and 88. Thus, the effect of amplifier 74 driving transistor 68 harder to increase the output current beyond the maximum is to turn off transistors 66 and 80, thereby folding back the current output without any additional circuitry.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A voltage regulator for providing a regulated voltage on an output responsive to a voltage ($V_{trk}$), said voltage regulator comprising:

an error amplifier having a first input for receiving the voltage ($V_{trk}$), having an second input coupled to the output of the voltage regulator, and having an output;

a pass transistor having a current path between a voltage source and the output of the voltage regulator, and having a control element, a first transistor having a control element coupled to the output of the error amplifier, and having a current path with a first end and a second end;

a second transistor having a control element for receiving a bias voltage and having a current path with a first end coupled to the source voltage and a second end, wherein the current path of the first transistor is in parallel with the current path of the second transistor;

a fixed current source coupled in series with the current path of the first transistor and the current path of the second transistor; and an output transistor having a current path coupled in series the current path of the first transistor and having a control element coupled to its current path and to the control element of the pass element.

2. The current limiting circuit of claim 1 wherein the first and second transistor comprise bipolar transistors and the output transistor is a MOSFET transistor.

3. The current limiting circuit of claim 2 wherein the first and second transistors are NPN bipolar transistors.

4. The current limiting circuit of claim 2 wherein the output transistor is a p-channel MOSFET transistor.

5. The current limiting circuit of claim 1 wherein the fixed current source comprises a current mirror.

* * * * *